US009561875B2

(12) United States Patent
Xie et al.

(10) Patent No.: US 9,561,875 B2
(45) Date of Patent: Feb. 7, 2017

(54) BINDING MEDIUM CLAMPING MECHANISM AND BANKNOTE BINDING MACHINE CONTAINING SAME

(71) Applicant: GRG Banking Equipment Co., Ltd., Guangzhou, Guangdong (CN)

(72) Inventors: Weiping Xie, Guangdong (CN); Dieqiang Situ, Guangdong (CN); Fan Chen, Guangdong (CN); Tianrui Li, Guangdong (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 14/782,581

(22) PCT Filed: Feb. 13, 2014

(86) PCT No.: PCT/CN2014/072035
§ 371 (c)(1),
(2) Date: Oct. 5, 2015

(87) PCT Pub. No.: WO2014/190783
PCT Pub. Date: Dec. 4, 2014

(65) Prior Publication Data

US 2016/0304223 A1 Oct. 20, 2016

(30) Foreign Application Priority Data

May 28, 2013 (CN) ..... 2013 1 0203968

(51) Int. Cl.
*B65B 13/10* (2006.01)
*B65B 27/08* (2006.01)

(52) U.S. Cl.
CPC ..... *B65B 13/10* (2013.01); *B65B 27/08* (2013.01)

(58) Field of Classification Search
CPC ..... B65B 13/08; B65B 13/10; B65B 13/12; B65B 13/14; B65B 13/32; B65B 11/04; B65B 11/045; B65B 27/08; B65B 59/00; Y10T 156/1028
(Continued)

(56) References Cited

U.S. PATENT DOCUMENTS 3,233,385 A * 2/1966 Lyon ..... B65B 13/10 100/27
4,155,213 A * 5/1979 Blanton ..... B65B 13/32 100/15
(Continued)

FOREIGN PATENT DOCUMENTS

CN 2232398 Y 8/1996
CN 2790910 Y 6/2006
(Continued)

OTHER PUBLICATIONS

Written Opinion of the International Searching Authority, dated May 6, 2014, from corresponding International Application No. PCT/CN2014/072035.
(Continued)

*Primary Examiner* — Jimmy T Nguyen
(74) *Attorney, Agent, or Firm* — Wolf, Greenfield & Sacks, P.C.

(57) ABSTRACT

A binding medium clamping mechanism includes a rotatable clamping element configured to clamp a binding medium, a driving element configured to drive the clamping element, a one-way transmission element connected between the driving element and the clamping element, and a rotatable clamping head opening element configured to open the clamping element, wherein in the case that the clamping element rotates in a first rotation direction to a position for waiting to clamp the binding medium, the positions of the clamping element and the clamping head opening element
(Continued)

interferes with each other, to open the clamping element, and in the case that the clamping element rotates in a second rotation direction opposite to the first rotation direction, the clamping head opening element is pushed by the clamping element to rotate in the first rotation direction to move out of a moving track of the clamping element.

18 Claims, 5 Drawing Sheets

(58) Field of Classification Search
USPC ..... 100/9, 16, 27, 28, 33 PB; 53/587, 588, 53/589, 210, 211; 156/475, 502
See application file for complete search history.

(56) References Cited

U.S. PATENT DOCUMENTS

| | | | | |
|---|---|---|---|---|
| 4,499,709 | A | 2/1985 | Miyano et al. | |
| 4,539,789 | A * | 9/1985 | Miyano | B65B 27/08 100/33 PB |
| 2010/0254781 | A1 | 10/2010 | Watanabe | |

FOREIGN PATENT DOCUMENTS

| | | | |
|---|---|---|---|
| CN | 101434301 | A | 5/2009 |
| CN | 101595034 | A | 12/2009 |
| CN | 102101241 | A | 6/2011 |
| CN | 102101541 | A | 6/2011 |
| CN | 102910309 | A | 2/2013 |
| CN | 103274071 | A | 9/2013 |
| EP | 0420560 | A1 | 4/1991 |
| EP | 0540134 | A2 | 5/1993 |
| EP | 0 685 418 | A | 12/1995 |

OTHER PUBLICATIONS

Extended European Search Report, dated May 3, 2016, from corresponding European Application No. 14804317.7.
Notice of Acceptance, dated Jan. 30, 2016, from corresponding Australian Application No. 2014273775.
Chinese Office Action, dated Jul. 3, 2014, from corresponding Chinese Application No. 201310203968.X.
International Search Report, dated Apr. 11, 2014, from Corresponding International Application No. PCT/CN2014/072035.

* cited by examiner

BINDING MEDIUM CLAMPING MECHANISM AND BANKNOTE BINDING MACHINE CONTAINING SAME

This application is the national phase of International Application No. PCT/CN2014/072035, titled "BINDING MEDIUM CLAMPING MECHANISM AND BANKNOTE BINDING MACHINE CONTAINING SAME", filed on Feb. 13, 2014, which claims the benefit of priority to Chinese Patent Application No. 201310203968.X titled "BINDING MEDIUM CLAMPING MECHANISM AND BANKNOTE BINDING MACHINE HAVING THE SAME", filed with the Chinese State Intellectual Property Office on May 28, 2013, each of which applications is incorporated herein by reference to the maximum extent allowable by law.

TECHNICAL FIELD

The present application relates to special financial equipments, and particularly to a binding medium clamping mechanism applied on a banknote binding machine.

BACKGROUND

A binding medium of an existing banknote binding machine is pulled by a track or a clamping mechanism to bind a stack of banknotes to be bound. When the binding medium is pulled by the clamping mechanism, the clamping mechanism is required to be opened quickly and stably, and after being opened, the clamping mechanism is required to stop at a certain position and wait for the binding medium to enter. However, when the current binding medium clamping mechanism stops at the certain position, a retaining force of an actuating device is used to prevent the position of the clamping device from changing in the opening process, which has a high requirement on the actuating device. Further, an additional actuating device is required to open the clamping mechanism, thus the mechanism has a complicated structure and a high economic cost.

SUMMARY

For solving the above issues, an object of the present application is to provide a binding medium clamping mechanism, which may simplify and miniaturize the structure, and lower the manufacturing cost.

Another object of the present application is to provide a banknote binding machine having the binding medium clamping structure.

For realizing the above objects, the following solutions are provided. A binding medium clamping mechanism includes a rotatable clamping element configured to clamp a binding medium, a driving element configured to drive the clamping element, a one-way transmission element connected between the driving element and the clamping element, and a rotatable clamping head opening element configured to open the clamping element, wherein in the case that the clamping element rotates in a first rotation direction to a position for waiting to clamp the binding medium, the positions of the clamping element and the clamping head opening element interferes with each other, to open the clamping element, and in the case that the clamping element rotates in a second rotation direction opposite to the first rotation direction, the clamping head opening element is pushed by the clamping element to rotate in the first rotation direction to move out of a moving track of the clamping element.

The clamping head opening element is configured to return to its original position due to its own gravity in the case that the clamping element continues to push the clamping head opening element and is disengaged from the clamping head opening element.

A limiting portion is arranged below the clamping head opening element, and the clamping head opening element is supported on the limiting portion and is restricted from rotating in the second rotation direction by the limiting portion.

The limiting portion is located on a moving track of the clamping head opening element, on a connecting line between a rotation center of the clamping head opening element and a rotation center of the clamping element, or in an area between the rotation center of the clamping head opening element and a tangent of the moving track of the clamping element.

The one-way transmission element is a transmission structure having a worm and a worm wheel, and the driving element, the worm, the worm wheel and the clamping element are connected in the listed sequence.

The clamping element includes two clamping sheet connected by a shaft, and an elastic element configured to maintain one end of each of the two clamping sheets in a clamped state.

The clamping element further includes a rotating seat, and one of the two clamping sheets is fixed to the rotating seat to be connected to the one-way transmission element.

The driving element and the one-way transmission element are mounted on a fixing seat and are covered by a housing, and the clamping element is mounted on the one-way transmission element and extends out of the housing.

The driving element and the one-way transmission element are mounted on a fixing seat and are covered by a housing, and the clamping head opening element is rotatably arranged in the housing by a pin, and the limiting portion is fixed in the housing.

The clamping element according to the present application may be driven by the driving element to move along a predetermined track, and when the clamping element stops, the clamping element can be locked at the stopping position by the one-way transmission element, and at the same time, by skillfully arranging the clamping head opening element, the clamping head opening element interferes with the clamping element when it is required to open the clamping element, and the rotation of the clamping element would not be impeded at other times. The entire structure is simple and compact and the manufacture cost is low.

Figure 1:
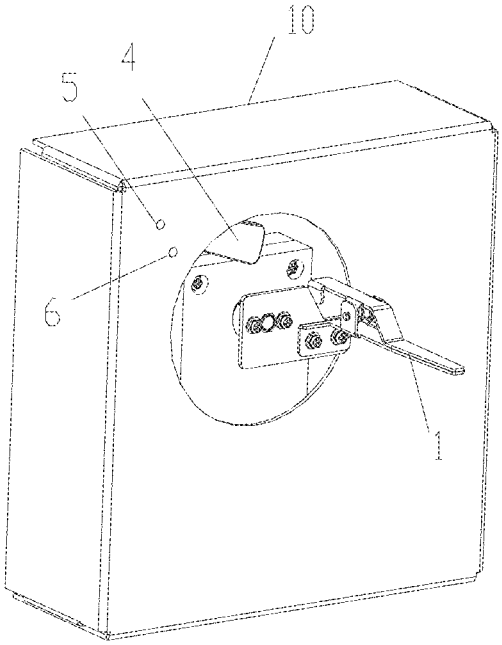
FIG. 1 is a perspective view of a binding medium clamping mechanism according to the present application (which is covered by a housing 10)
Figure 2:
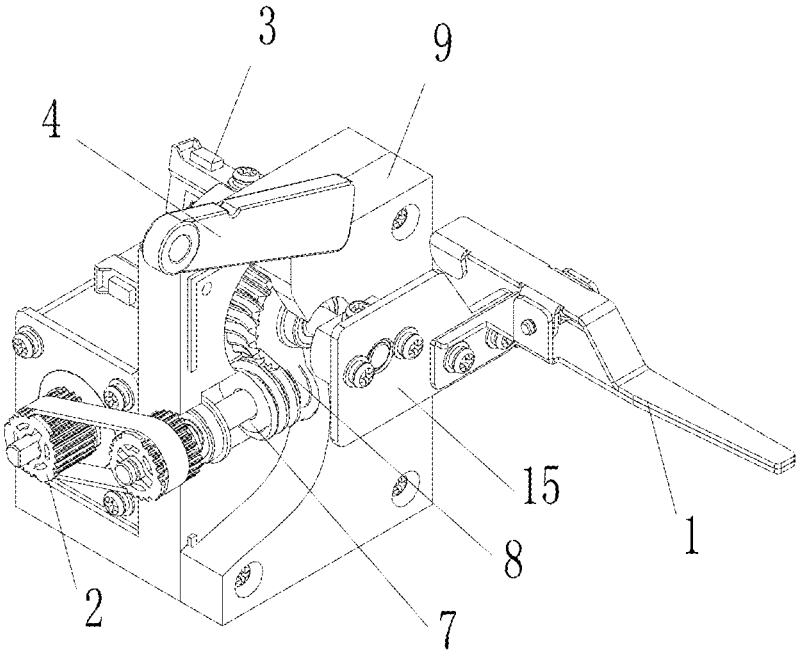
FIG. 2 is a partial sectional view of the binding medium clamping mechanism according to the present application (with the housing 10 removed)
Figure 3:
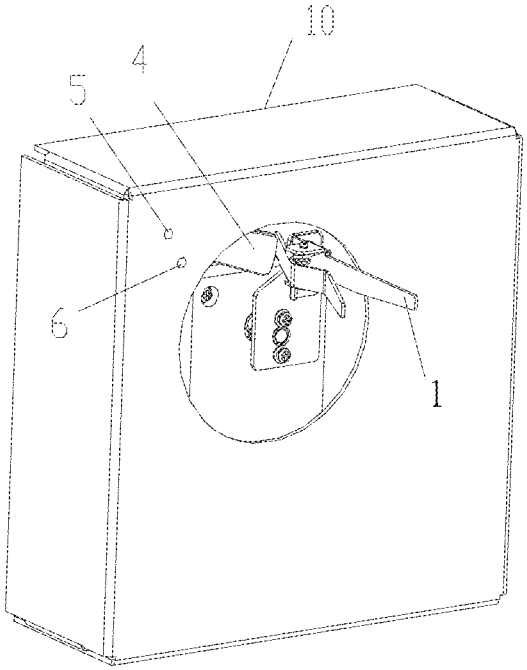
FIG. 3 is a perspective view of the binding medium clamping mechanism according to the present application with a clamping element in an open state (wherein the mechanism is covered by a housing 10)
Figure 4:
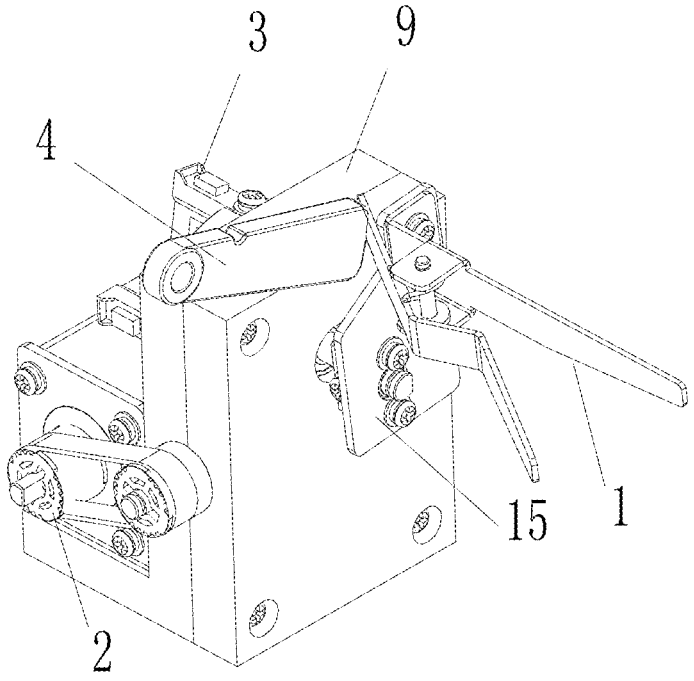
FIG. 4 is a perspective view of the binding medium clamping mechanism according to the present application with the clamping element in an open state (wherein the mechanism is shown with the housing 10 removed)
Figure 5:
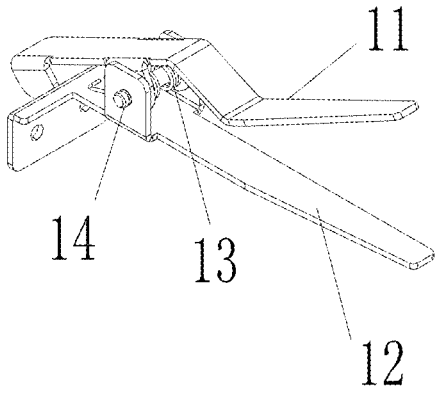
FIG. 5 is a schematic view showing the structure of the clamping element in an open state according to the present application.

| Reference Numerals: | | | |
|---|---|---|---|
| 1 | clamping element; | 2 | driving element; |
| 3 | position sensor; | 4 | clamping head opening element; |
| 5 | pin; | 6 | pin; |
| 7 | worm; | 8 | worm wheel; |
| 9 | fixing seat; | 10 | housing; |
| 11 | clamping sheet; | 12 | clamping sheet; |
| 13 | elastic element; | 14 | shaft; |
| 15 | rotating seat; | 16 | binding medium; |
| 17 | stack of banknotes. | | |

DETAILED DESCRIPTION

The technical solution of the present application is further described in conjunction with drawings, and the present application is not limited to the embodiments.

A binding medium clamping mechanism applied on a banknote binding machine is provided according to the present application, which includes a clamping element 1, a driving element 2, a position sensor 3, a clamping head opening element 4, a one-way transmission element, a fixing seat 9, a housing 10, and etc. The driving element 2, the position sensor 3, and the one-way transmission element are all mounted on the fixing seat 9, and are all covered by the housing 10. The clamping element 1 is mounted on the one-way transmission element and extends out of the housing 10.

The clamping element 1 for clamping a binding medium 16 is rotatably mounted on the fixing seat 9. The clamping element 1 may have any structure, as long as it is capable of realizing an opened state and a clamped state. The clamping element 1 may be embodied as a common clamping structure, for example, in this embodiment, the clamping element 1 includes a clamping sheet 11, a clamping sheet 12, an elastic element 13 and a shaft 14. The two clamping sheets 11, 12 are connected by the shaft 14. The elastic element 13 is a torsional spring sleeved on the shaft 14, and has two ends abutting against one end of the clamping sheet 11 and one end of the clamping sheet 12, respectively, thus another end of the clamping sheet 11 and another end of the clamping sheet 12 may be kept in a clamped state. The clamping sheet 12 is fixed on a rotating seat 15 by a screw. The rotating seat 15 is connected to a worm wheel 8 which will be described hereinafter, and is rotated by the worm wheel 8. The position sensor 3 is configured to sense the clamping element 1 and control the clamping element 1 to stay at a position waiting for clamping the binding medium 16.

The driving element 2 is configured to drive the clamping element 1, and the driving element 2 and the clamping element 1 are drivably connected by the one-way transmission element. In this embodiment, the one-way transmission element is embodied as a transmission structure having a worm 7 and the worm wheel 8. The driving element 2, the worm 7, the worm wheel 8 and the clamping element 1 are connected in the listed sequence. The driving element 2 is configured to drive the worm 7, and then the worm 7 drives the worm wheel 8 and the clamping element 1 to rotate clockwise or anticlockwise. After the clamping element 1 reaches a position for clamping the paper tape, the driving element 2 stops driving, and the clamping element 1 may be stably retained at the certain position by the self-locking feature of the worm 7 and the worm wheel 8 and wait the paper tape to enter.

The clamping head opening element 4 is rotatable and configured to open the clamping element. When the clamping element 1 rotates to a position waiting for clamping the binding medium 16 in a first rotation direction (for example, in a clockwise direction), the positions of the clamping head opening element 4 and the clamping element 1 interferes with each other, which allows the clamping head opening element 4 to open the clamping element 1. When the clamping element 1 rotates in a second rotation direction (for example, in an anti-clockwise direction) opposite to the first rotation direction, the clamping head opening element 4 is pushed in the first rotation direction (i.e. in the clockwise direction) to move out of a moving track of the clamping element 1. When the clamping element 1 continues to push the clamping head opening element 4 and is disengaged form the clamping head opening element 4, the clamping head opening element 4 returns to the original position due to its own gravity. In this embodiment, a pin 5 and a pin 6 are mounted on the housing 10, and the clamping head opening element 4 is mounted in the housing 4 by the pin 5. A limiting portion (the pin 6) is arranged below the clamping head opening element 4, and the clamping head opening element 4 is supported on the pin 6 and is restricted from rotating in the clockwise direction by the pin 6, thus the clamping head opening element 4 has a feature of rotating unidirectionally at a certain angle. The limiting portion (the pin 6) is located on the moving track of the clamping head opening element 4, for example, located on the connecting line between the rotation center (i.e. the pin 5) of the clamping head opening element 4 and the rotation center of the clamping element 1, or located in an area between the rotation center (i.e. the pin 5) of the clamping head opening element 4 and a tangent of the moving track of the clamping element 1.

Figures 6A, 6B, 6C:
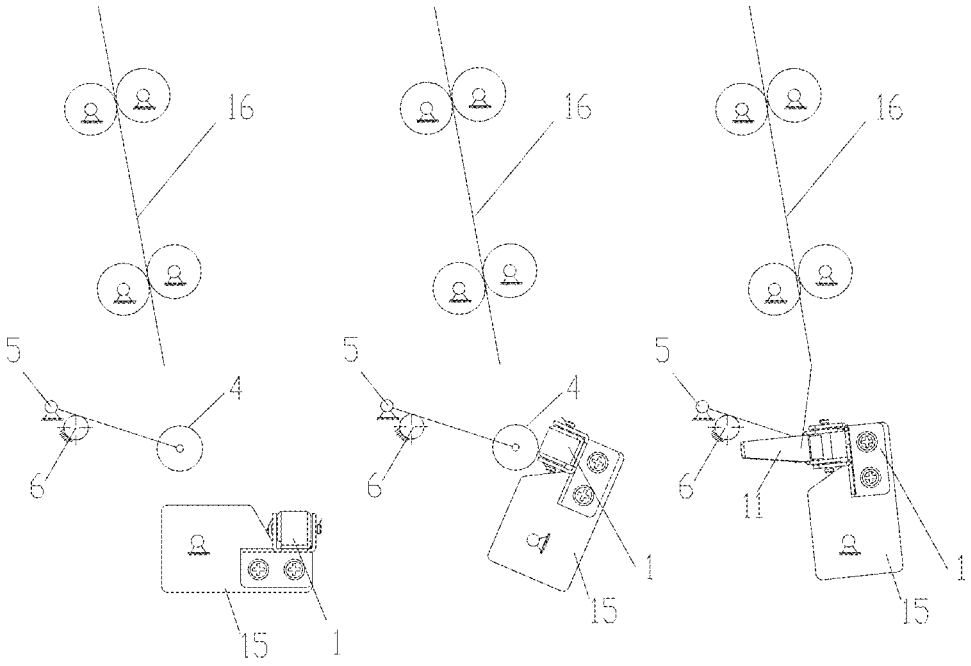
FIGS. 6*a*-6*f* are schematic views showing six continuous operating states of the binding medium clamping mechanism according to the present application.
Figure 6D:
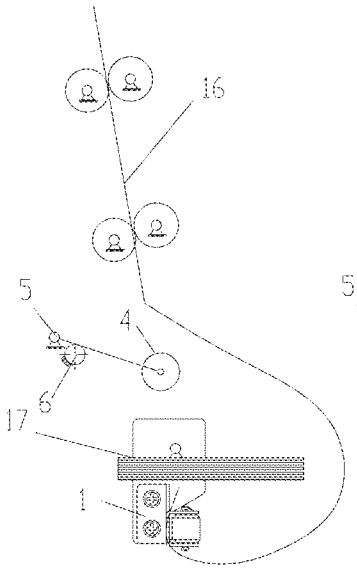
Figure 6E:
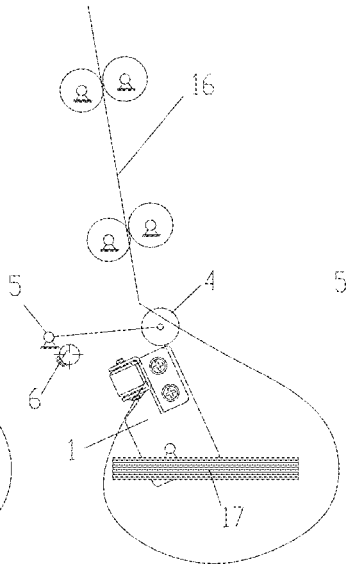
Figure 6F:
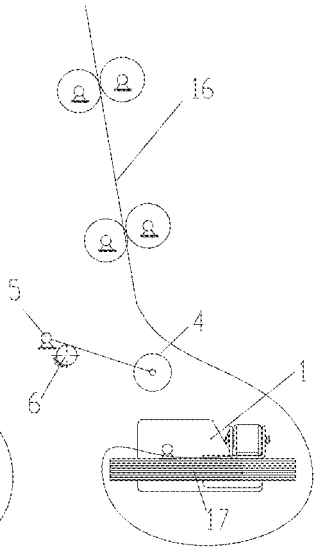

As shown in FIG. 6*a*, the clamping element 1 is located at an initial position before operation. When it is required to open the clamping element 1 to clamp the binding medium 16 (the paper tape), the clamping element 1 is rotated by the driving element 2 in the anti-clockwise direction and is stopped by the position sensor 3 at a position for clamping the binding medium 16. At this position, the positions of the clamping element 1 and the clamping head opening element 4 interferes with each other. As shown in FIG. 6*b*, when the clamping element 1 impacts the clamping head opening element 4 in the anti-clockwise direction, the clamping head opening element 4 is subjected to the impact force, thus having a trend of rotating about the pin 5 in the clockwise direction, however, the clamping head opening element 4 cannot rotate in the clockwise direction due to the limitation of the pin 6. Thus, the clamping head opening element 4 applies a counter force on the clamping element 1 to open the clamping element 1. When the clamping element 1 rotating in the anti-clockwise direction just impacts the clamping head opening element 4, the clamping element 1 has not reached the position determined by the position sensor 3, as shown in FIG. 6*c*, thus the clamping element 1 is driven by the driving element 2 to continue to rotate in the anti-clockwise direction. At this time, the clamping sheet 11 compresses the elastic element 13 and rotates about the shaft 14 due to the interference of the clamping head opening element 4, thus the clamping sheet 11 is opened. The opening angle of the clamping sheet 11 may be adjusted according to the geometric dimensions of the clamping element 1 and the clamping head opening element 4 and the position relationship therebetween. When the clamping element 1 reaches the predetermined position for clamping the binding medium 16, the driving element 2 stops driving. Although the clamping element 1 is still pushed by the clamping head opening element 4, the clamping element 1 may stay steadily at the predetermined position due to the self-locking feature of the worm 7 and the worm wheel 8 and wait the binding medium 16 to enter. As shown in FIG. 6*d*, the binding medium 16 enters between the clamping sheet 11 and the clamping sheet 12 by a turning roller, and then the clamping element 1 rotates in the clockwise direction to move away from the clamping head opening element 4, thus, the interference between the clamping head opening element 4 and the clamping element 1 is eliminated, and the clamping sheet 11 and the clamping sheet 12 clamp the binding medium 16 under the action of the elastic element 10 and pull the binding medium 16 to form an annular band. Before the annular band is closed, a stack of banknotes 17 enters the annular band, as shown in FIG. 6*e*, and then the clamping element 1 continues to rotate in the clockwise direction. When the clamping element 1 rotating in the clockwise direction impacts the clamping head opening element 4, the clamping head opening element 4 rotates upwards in the anti-clockwise direction to allow the clamping element 1 to pass. As shown in FIG. 6*f*, the clamping element 1 returns to the initial horizontal position successfully and pulls the binding medium 16 to form a closed paper loop to bind the stack of the banknotes 17. This path for forming the loop with the binding medium 16 is the optimum path.

A banknote binding machine having the binding medium clamping mechanism has a simple and compact structure and a low manufacturing cost.

The invention claimed is:

1. A binding medium clamping mechanism, comprising:
a rotatable clamping element configured to clamp a binding medium,
a driving element configured to drive the clamping element,
a one-way transmission element connected between the driving element and the clamping element, and
a rotatable clamping head opening element configured to open the clamping element, wherein in the case that the clamping element rotates in a first rotation direction to a position for waiting to clamp the binding medium, positions of the clamping element and the clamping head opening element interferes with each other to open the clamping element, and in the case that the clamping element rotates in a second rotation direction opposite to the first rotation direction, the clamping head opening element is pushed by the clamping element to rotate in the first rotation direction to move out of a moving track of the clamping element.

2. The binding medium clamping mechanism according to claim 1, wherein, the clamping head opening element is configured to return to its original position due to its own gravity in the case that the clamping element continues to push the clamping head opening element and is disengaged from the clamping head opening element.

3. The binding medium clamping mechanism according to claim 1, wherein a limiting portion is arranged below the clamping head opening element, and the clamping head opening element is supported on the limiting portion and is restricted from rotating in the second rotation direction by the limiting portion.

4. The binding medium clamping mechanism according to claim 3, the limiting portion is located on a moving track of the clamping head opening element, on a connecting line between a rotation center of the clamping head opening element and a rotation center of the clamping element, or in an area between the rotation center of the clamping head opening element and a tangent of the moving track of the clamping element.

5. The binding medium clamping mechanism according to claim 1, wherein the one-way transmission element is a transmission structure having a worm and a worm wheel, and the driving element, the worm, the worm wheel and the clamping element are connected in said cases.

6. The binding medium clamping mechanism according to claim 1, wherein the clamping element comprises two clamping sheet connected by a shaft, and an elastic element configured to maintain one end of each of the two clamping sheets in a clamped state.

7. The binding medium clamping mechanism according to claim 6, wherein the clamping element further comprises a rotating seat, and one of the two clamping sheets is fixed to the rotating seat to be connected to the one-way transmission element.

8. The binding medium clamping mechanism according to claim 1, wherein the driving element and the one-way transmission element are mounted on a fixing seat and are covered by a housing, and the clamping element is mounted on the one-way transmission element and extends out of the housing.

9. The binding medium clamping mechanism according to claim 3, wherein the driving element and the one-way transmission element are mounted on a fixing seat and are covered by a housing, and the clamping head opening element is rotatably arranged in the housing by a pin, and the limiting portion is fixed in the housing.

10. A banknote binding machine, comprising a binding medium clamping mechanism, and the binding medium clamping mechanism comprises a rotatable clamping element configured to clamp a binding medium, a driving element configured to drive the clamping element, a one-way transmission element connected between the driving element and the clamping element, and a rotatable clamping head opening element configured to open the clamping element, wherein in the case that the clamping element rotates in a first rotation direction to a position for waiting to clamp the binding medium, positions of the clamping element and the clamping head opening element interferes with each other to open the clamping element, and in the case that the clamping element rotates in a second rotation direction opposite to the first rotation direction, the clamping head opening element is pushed by the clamping element to rotate in the first rotation direction to move out of a moving track of the clamping element.

11. The banknote binding machine according to claim 10, wherein the clamping head opening element is configured to return to its original position due to its own gravity in the case that the clamping element continues to push the clamping head opening element and is disengaged from the clamping head opening element.

12. The banknote binding machine according to claim 10, wherein a limiting portion is arranged below the clamping head opening element, and the clamping head opening element is supported on the limiting portion and is restricted from rotating in the second rotation direction by the limiting portion.

13. The banknote binding machine according to claim 12, wherein the limiting portion is located on a moving track of the clamping head opening element, on a connecting line between a rotation center of the clamping head opening element and a rotation center of the clamping element, or in an area between the rotation center of the clamping head opening element and a tangent of the moving track of the clamping element.

14. The banknote binding machine according to claim 10, wherein the one-way transmission element is a transmission structure having a worm and a worm wheel, and the driving element, the worm, the worm wheel and the clamping element are connected in said cases.

15. The banknote binding machine according to claim 10, wherein the clamping element comprises two clamping sheet connected by a shaft, and an elastic element configured to maintain one end of each of the two clamping sheets in a clamped state.

16. The banknote binding machine according to claim 15, wherein the clamping element further comprises a rotating seat, and one of the two clamping sheets is fixed to the rotating seat to be connected to the one-way transmission element.

17. The banknote binding machine according to claim 10, wherein the driving element and the one-way transmission element are mounted on a fixing seat and are covered by a housing, and the clamping element is mounted on the one-way transmission element and extends out of the housing.

18. The banknote binding machine according to claim 12, wherein the driving element and the one-way transmission element are mounted on a fixing seat and are covered by a housing, and the clamping head opening element is rotatably arranged in the housing by a pin, and the limiting portion is fixed in the housing.

* * * * *